United States Patent [19]

Chiang

[11] Patent Number: 4,572,112

[45] Date of Patent: Feb. 25, 1986

[54] APPARATUS FOR FEEDING STEAM/LIQUID INTO A STEAM GENERATOR

[76] Inventor: Jaw-Cheng Chiang, No. 6, Hsin Kai Yuen, Ching Yuen Village, Tzi Sang Hsiung, Tai Don Hsien, Taiwan

[21] Appl. No.: 721,998

[22] Filed: Apr. 11, 1985

[51] Int. Cl.[4] ..... F22D 5/26

[52] U.S. Cl. ..... 122/451 R; 122/406 R; 122/406 S; 122/451 S

[58] Field of Search ..... 122/451 R, 451 S, 451.2, 122/406 R, 406 S, 406 ST

[56] References Cited

U.S. PATENT DOCUMENTS

| | | | |
|---|---|---|---|
| 3,487,465 | 12/1969 | Lazarewicz | 122/451 R |
| 4,207,842 | 6/1980 | Kehutofer | 122/406 S |
| 4,211,188 | 7/1980 | Chen | 122/451 R |
| 4,227,489 | 10/1980 | Regamey | 122/451 |
| 4,304,197 | 12/1981 | Okamoto | 122/451 R |
| 4,404,930 | 9/1983 | Chen | 122/451 R |

*Primary Examiner*—Edward G. Favors

*Attorney, Agent, or Firm*—Morgan, Finnegan, Pine, Foley & Lee

[57] ABSTRACT

A fluid feeding apparatus can gradually elevate the head of a fluid of steam/liquid mixture by recirculating the fluid through a centrifugal pump of moderate output and an injector. The fluid ejecting out of the nozzle of the injector will entrain a steam/liquid mixture of high latent heat from a fluid intake port so that the heat energy of the condensate from the other sources can be recovered and reused. By virtue of providing a gas intake port for the injector, the fluid can be supplemented with gas wherever needed. Due to the substantial volume of the gas phase in the reservoir, the internal pressure of the reservoir will not increase drastically because of the dampering effect of the gas phase. Thus only a centrifugal pump of moderate output is needed for implementing the recirculation of the elevation of the pressure in the reservoir.

6 Claims, 2 Drawing Figures

APPARATUS FOR FEEDING STEAM/LIQUID INTO A STEAM GENERATOR

BACKGROUND OF THE INVENTION

The present invention is related to an apparatus for feeding a fluid of elevated pressure into a steam generator, and particularly to a fluid feeding apparatus capable of gradually and circulatorily elevating the head of a fluid. By and large, to supply liquid into a pressure vessel, it is necessary to raise the head of the liquid to an amount higher than the internal pressure of the vessel by a pump of high output, such as a multi-stage turbine pump. However, the utilization of such a pump has disadvantages in that, unless one allows for high electricity consumption, it is rather difficult to maintain a plurality of impellers which are connected in tandem, in balance.

If the factory intends to recover condensates of various pressures and temperatures from different sources and feed them into a steam boiler for the sake of saving energy, one would encounter great difficulty, such as back pressure resulting in the exhaust port of a steam trap. In oder to maintain the temperature as the highest possible level and to eliminate the loss of the flash stream, generally a closed recovery system is adopted. In the closed recovery system, the condensates of different pressures from different steam traps are directed into a reservoir which is kept at the lowest pressure by releasing the excess pressure through a pressure control valve to prevent it from causing back pressure. As a consequence, a high-output pump of a centrifugal type is necessary for feeding the condensate into a steam boiler. Taking the net positive suction head into consideration, the pressure on the impeller will oftentimes be greatly reduced, which will result in the phenomenon of flash steam. The phenomenon of the flash steam brings the pump into idle motion so as to cause cavation and water hammer and can cause damage to the pump. To eliminate the phenomenon of flash steam, an additional means for elevating the pressure should be provided for streamlining the operation. However, in view of the fact that in a closed heat recovery system, when the temperature of the recovered condensate reaches 120 degrees Centigrade, about 1 kg/cm$^2$G of back pressure at the exhaust port of the steam trap is created, whereas when the temperature is raised to up to 145 degrees Centigrade, up to 3 kg/cm$^2$G of back pressure will result. In order to avoid confronting this problem, some factories would rather continue to utilize the open recovery system and discharge a great deal of heat energy into the atmosphere.

In Taiwan Utility Model Pat. No. 23879 issued to this inventor, a closed recovery system is disclosed as schematically shown in FIG. 1, In the prior invention, the condensates of various pressures are divided into a first condensate of a pressure higher than a pressure of a second condensate which acts as an actuating fluid for the second condensate in an injector. Subsequently a third condensate of the highest pressure acts as an actuating fluid for the mixture of the first and second condensates, and etc. After a series of operations of injectors, the pressure of the recovered condensates will gradually increase without the drawback of the accompanying problem of back pressure. The pressure of the intermixed condensate through the last operation of the injector can be elevated as an actuating fluid so that the pressure of the intermixed condensate can be further elevated to a desired value. However, a system for implementing the above process is rather bulky, and further improvement over the prior system is still attempted.

SUMMARY OF THE INVENTION

It is an object of the present invention to provide a fluid feeding apparatus, in which the condensates of different pressures can fully intermix without substantially sacrificing the latent heat of the condensates.

It is another object to provide a fluid feeding apparatus which can create a satisfactory static high pressure of recovered condensate for being fed into a steam generator while keeping the size of the apparatus to a minimum.

Accordingly, a fluid feeding apparatus capable of gradually elevating the head of a fluid of steam/liquid mixture for forcing it into a steam generator comprises, a fluid reservoir for forming a static pressure including an upper inlet and a lower outlet; a pump having an entrance port communicating with said lower outlet, and an exhaust port; an injector means including a rear tube portion communicating with said exhaust port, a front nozzle portion pointing toward said upper inlet, and a fluid intake port disposed in the vicinity of said front nozzle portion whereby the fluid from the lower outlet will be actuated by the pump to elevate its head and be ejected to the upper inlet while a fluid of lower pressure from the intake port will be entrained into said upper inlet so that the intermixed fluid of different pressures will attain a static pressure in the fluid reservoir for the next circulatory head elevation.

Preferably, said fluid intake port includes a port for intaking a gas.

More preferably, means for regulating the opening and closing of said fluid intake port, and means for detecting a predetermined level of said liquid in the reservoir to actuate said regulating means to open or close said fluid intake port are further disposed.

More preferably, said fluid reservoir includes a first chamber and a second chamber sealingly enclosing said first chamber having an upper opening sealingly communicating with said upper outlet, and a hole disposed on the wall between said first chamber and said second chamber, and at a position beyond said predetermined level so as not to greatly disturb the level of the existing liquid in the fluid reservoir.

More preferably, a plurality of baffles are further disposed on the outer wall of said first chamber and on the inner wall of said second chamber for distributing the liquid uniformly.

The presently preferred exemplary embodiments will be illustrated with reference to the following drawings, wherein:

DETAILED DESCRIPTION OF THE PREFERRED EMBODIMENTS

Figure 1:
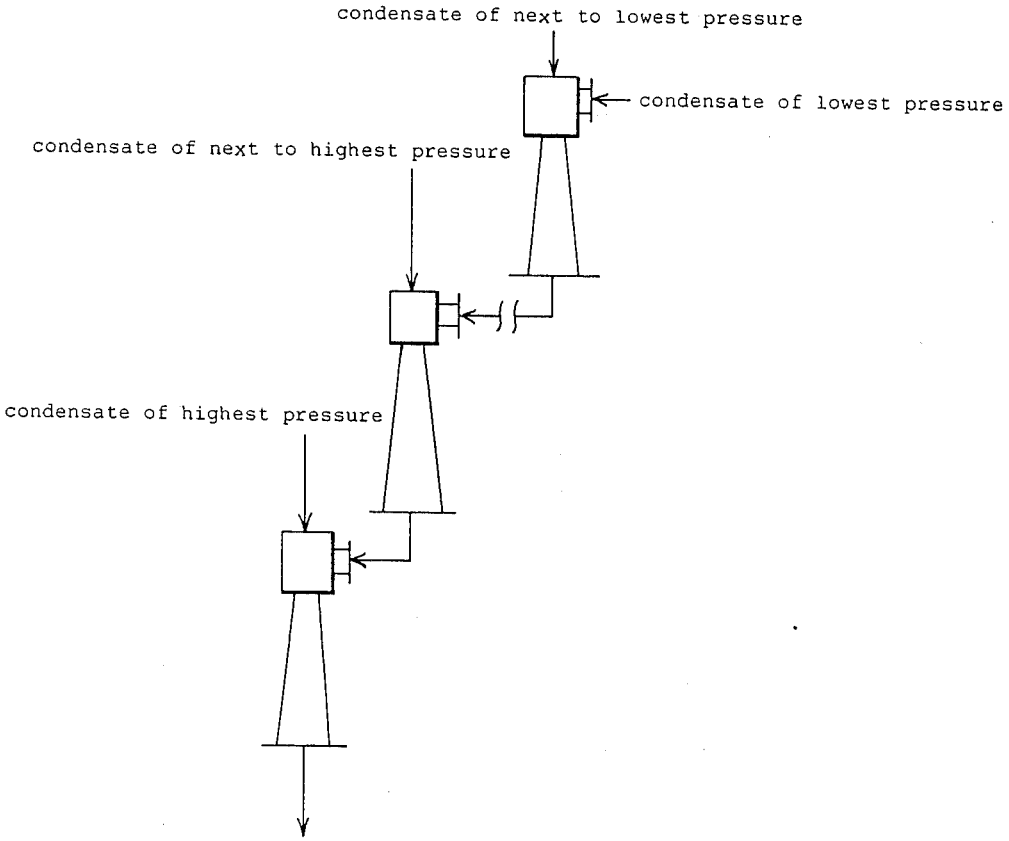
FIG 1 Prior Art
FIG. 1 is a schematic view of the prior art illustrating how to gradually intermix the condensates of different pressures.
Figure 2:
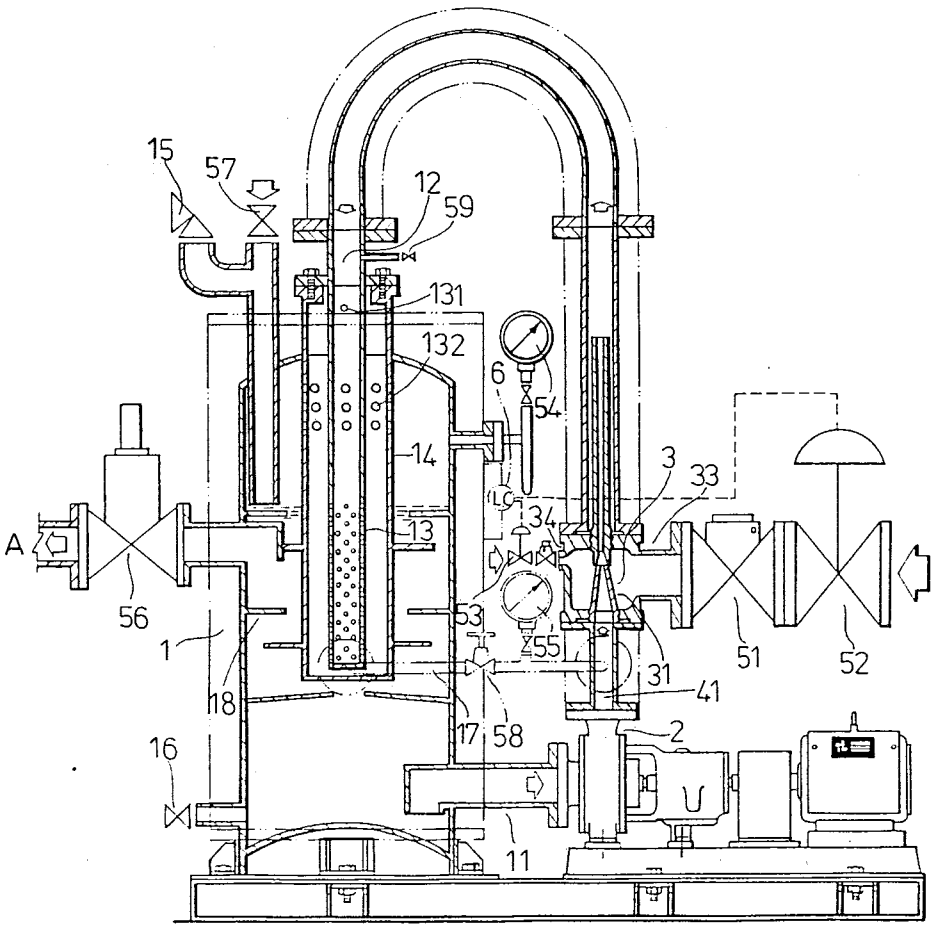
FIG. 2 is a schematic view of a preferred embodiment according to the present invention.

Now referring to FIG. 2, there is shown a fluid reservoir 1 including a lower outlet 11 and an upper inlet 12. The lower outlet is connected to an entrance port of a centrifugal pump 2 which has its exhaust port communicated with a rear tube portion 41 of an injector 3. A front nozzle portion 31 is tapered and pointing toward the upper inlet 12 for ejecting the fluid driven through the centrifugal pump 2 into the upper inlet of the fluid reservoir 1. Near the front nozzle portion 31, two fluid intake ports, one for intaking gas 34 and one for intaking fluid of steam/liquid mixture 33, are provided. A cylindrical chamber 14 is sealingly communicated with the upper inlet 12 which has a tubular portion 13 extending proximate to the bottom of the cylindrical chamber 14. The tubular portion 13 has a hole 131 for allowing the gas to flow through provided on the upper wall thereof and a plurality of holes 132 for allowing the liquid to flow through provided on the lower wall thereof in an attempt to distribute the gas and the liquid existing in the incoming fluid. At the upper wall of the cylindrical chamber 14, a plurality of holes are provided to further distribute the liquid from the fluid. A relief valve 15 is provided for the purpose of safety and a draining port 16 is provided for drainage of the contents of the reservoir 1. A bypass 17 is disposed to communicate the rear tube portion 41 of the injector with the cylindrical chamber 14 and a valve 58 is provided for controlling the flow in the bypass 17. On the inner wall of the reservoir 1 and the outer wall of the cylindrical chamber 14, a plurality of baffles 18 are provided for preventing the inflowing liquid from greatly disturbing the state of the existing fluid. A check valve 51 is provided at the fluid intake port 33 of the injector 3. At the upstream of the check valve 51 there is an automatic control valve 52 which is actuated by a level controller 6. The level controller 6 is comprised of means for regulating the opening and closing of the control valve 52 and an automatic control valve 53 which governs the closing and opening of the gas intake port 34. as well as means for detecting a level of the fluid in the reservoir 1. For monitoring the internal pressure of the reservoir 1, a pressure gauge 54 is provided. By the same token, a pressure gauge 55 is provided at the bypass 17. Upstream of the relief valve 15, an offset with a valve 57 is provided for supplementing the liquid to the reservoir 1. An additional valve 59 can be also disposed on the upper inlet 12 at a position just before its tubular portion 13 and extending downward into the cylindrical chamber 14.

The operation of the preferred embodiment will be illustrated as hereinbelow. Before starting the operation, be sure that the draining port 16 and the valve 58 are duly closed. Set the level controller and predetermine the pressure of the condensate for feeding a steam generator (not shown) in the direction indicated by an arrow A. The valve 57 is opened to allow the supplementary liquid to flow through the offset while the additional valve 59 is opened so as to smooth the filling of the liquid in the reservoir 1. Until the liquid attains the appropriate level, the valves 57 and 59 are closed. Initiate the action of the centrifugal pump 2 to force the liquid of the reservoir 1 to eject into the upper inlet 12 through the nozzle portion 31. The ejecting liquid will create a reduced pressure near the nozzle portion 31 which will entrain the fluid of steam/liquid mixture from the fluid intake port 33 to form a intermixed fluid which will enter into the upper inlet 12 of the reservoir 1. The level of the liquid will descend at the very beginning as the liquid is suctioned by the centrifugal pump, and then rise to compress the gas phase in the reservoir 1. Once the level of the liquid rises beyond the predetermined level, the regulating means of the level controller 6 will be triggered to open the automatic control valve 34 and close the automatic control valve 52 so as to allow only the gas to be entrained by the ejecting liquid. Since the intake of the liquid from the automatic control valve 52 is discontinued, the level of liquid in the reservoir 1 will be kept at the pedetermined level. The running of the centrifugal pump 2 and the injector 3 which recirculates the liquid will result in gradual elevation of the pressure of the intermixed fluid with the aid of the intaking gas. Once the pressure of the intermixed fluid attains the desired value as indicated in the pressure gauge 54, and the intermixed liquid is ready for feeding the steam generator, the intermixed fluid will be forced against the internal pressure into the steam generator through the opening of a valve 56 which is governed by the predetermined level of the internal pressure in the reservoir 1. As the intermixed fluid is drawn out of the valve 56, the level of the liquid will move down below the predetermined value which will trigger the regulating means to open the automatic control valve 52 and to close the automatic control valve 34 to permit the steam/liquid mixture to again be entrained in the ejecting liquid. The operation of elevating the internal pressure of the reservoir 1 is then carried out over again.

In order to keep the level of the liquid in a stable condition, the downflow of the intermixed fluid from the upper inlet 12 is shielded by the bottom of the tubular portion 13 from direct impact on the level of the liquid. The gas part of the intermixed fluid will flow through the hole 131 while the liquid part of the intermixed fluid will flow through the holes 132, so that the steam and liquid of the intermixed fluid can be distributed into the gas and liquid phases without creating any turmoil in the stable condition of the liquid level. For producing the above effect, a plurality of baffles are further disposed on the inner wall of the reservoir 1 and the outer wall of the cylindrical chamber 14 for deflecting the downflow of the liquid in an attempt to minimize the momentum of the downflow which affects the stable condition of the existing liquid.

It can be noted that the internal pressure in the reservoir 1 will be gradually increased in view of the damping effect of the gas phase in the reservoir. Therefore, only the moderate output of the centrifugal pump 2 is necessary. As a consequence, the present invention will not have the aforementioned drawbacks confronted by the prior condensate feeding devices for steam generators.

While the invention has been described in connection with what is presently considered to be the most practical and preferred embodiments, it is to be understood that the invention is not to be limited to the disclosed embodiments but on the contrary, is intended to cover various modifications and equivalent arrangements included within the spirit and scope of the appended claims which scope is to be accorded the broadest interpretation so as to encompass all such modifications and equivalent structures.

I claim:

1. A fluid feeding apparatus capable of gradually elevating the head of a fluid of steam/liquid mixture for forcing it into a steam boiler, comprising:

a fluid reservoir for forming a static pressure including an upper inlet and a lower outlet;

a pump having an entrance port communicating with said lower outlet, and an exhaust port;

an injector means including a rear tube portion communicating with said exhaust port, a front nozzle portion pointing toward said upper inlet, and a fluid intake port disposed in the vicinity of said front nozzle portion, whereby the fluid from the lower outlet will be actuated by the pump to elevate its head and be ejected to the upper inlet while a fluid of lower pressure from the intake port will be entrained into said upper inlet so that the intermixed fluids of different pressures will attain a static pressure in the fluid reservoir for the next circulatory head elevation.

2. A fluid feeding apparatus for gradually elevating the head of the fluid according to claim 1, wherein said fluid intake port includes a port for intaking a gas.

3. A fluid feeding apparatus for gradually elevating the head of the fluid according to claim 1, further comprising means for regulating the opening and closing of said fluid intake port, and means for detecting a predetermined level of said liquid in the reservoir to actuate said regulating means to open or close said fluid intake port.

4. A fluid feeding apparatus for gradually elevating the head of the fluid according to claim 3, wherein said fluid reservoir includes a first chamber and a second chamber sealingly enclosing said first chamber in a vertical direction, said first chamber having an upper opening sealingly communicating with said upper outlet, and a hole disposed on the wall between said first chamber and said second chamber, and at a position beyond said predetermined level so as not to greatly disturb the level of the existing liquid in the fluid reservoir.

5. A fluid feeding apparatus for gradually elevating the head of the fluid according to claim 4, further comprising a plurality of baffles disposed on the outer wall of said first chamber and on the inner wall of said second chamber for distributing the liquid uniformly.

6. A fluid feeding apparatus for gradually elevating the head of the fluid according to claim 5, further comprising a valve disposed on the wall of said fluid reservoir for governing the feeding of the fluid to said steam generator, wherein the actuation of said valve is dictated by the predetermined internal pressure of said liquid reservoir.

* * * * *